US007575098B2

(12) United States Patent
Hartley

(10) Patent No.: US 7,575,098 B2
(45) Date of Patent: Aug. 18, 2009

(54) ATTIC LIFT SYSTEM AND METHOD

(76) Inventor: Jason Hartley, P.O. Box 1958, Whitehouse, TX (US) 75791

( * ) Notice: Subject to any disclaimer, the term of this patent is extended or adjusted under 35 U.S.C. 154(b) by 0 days.

(21) Appl. No.: 11/238,415

(22) Filed: Sep. 29, 2005

(65) Prior Publication Data

US 2007/0114098 A1 May 24, 2007

(51) Int. Cl.
*B66B 11/06* (2006.01)
*B66B 13/24* (2006.01)

(52) U.S. Cl. ..... 187/262; 187/261; 187/264; 187/336; 254/266; 312/247; 248/317; 248/330.1

(58) Field of Classification Search ..... 187/259, 187/264, 246, 336, 342, 412, 261, 262; 254/47, 254/266, 272, 277, 283; 312/246, 247; 267/166–180, 267/73, 74; 108/91; 248/330.1, 693, 317, 248/610, 613; 182/142–144, 146, 147
See application file for complete search history.

(56) References Cited

U.S. PATENT DOCUMENTS 22,980 A * 2/1859 Donkersley et al. ..... 70/303 R
155,306 A * 9/1874 Hinkle ..... 187/259
2,107,210 A * 2/1938 Palm ..... 414/137.2
2,595,135 A * 4/1952 Greenslade ..... 248/569
3,565,217 A * 2/1971 St. Louis ..... 187/256
3,796,285 A * 3/1974 Grebenstein ..... 187/255
4,412,601 A * 11/1983 Cooper ..... 312/242
5,224,677 A * 7/1993 Close ..... 248/292.11
5,535,852 A * 7/1996 Bishop et al. ..... 187/336
5,871,070 A * 2/1999 Contreras ..... 187/263
6,131,702 A * 10/2000 Berridge ..... 187/259
6,241,048 B1 * 6/2001 Heilmann ..... 187/263
6,367,757 B1 * 4/2002 Aramaki ..... 248/327

* cited by examiner

*Primary Examiner*—John Q. Nguyen
*Assistant Examiner*—Stefan Kruer
(74) *Attorney, Agent, or Firm*—Grady K. Bergen; Griggs Bergen LLP

(57) ABSTRACT

A lift system and method for lifting or lowering items from one level to another within a building is accomplished by providing a lift platform. An upper level support structure having an opening is configured to allow passage of the platform through the opening. The opening is suspended above a generally open area of a lower level. An upper level frame is coupled to the support structure. A winch having a motor that rotates a drum is supported by the upper level frame. A length of cable secures at one end to the winch and at the other end to the platform through a biasing member. Operation of the winch rotates the drum to wind or unwind the cable to raise or lower the platform through the open area of the lower level without any laterally adjacent support or guidance structure within the open area.

20 Claims, 4 Drawing Sheets

ATTIC LIFT SYSTEM AND METHOD

BACKGROUND

The invention relates generally to a lift system and method of lifting items or articles.

BRIEF DESCRIPTION OF THE DRAWINGS

For a more complete understanding of the present invention, reference is now made to the following descriptions taken in conjunction with the accompanying figures, in which.

DETAILED DESCRIPTION

Figure 1:
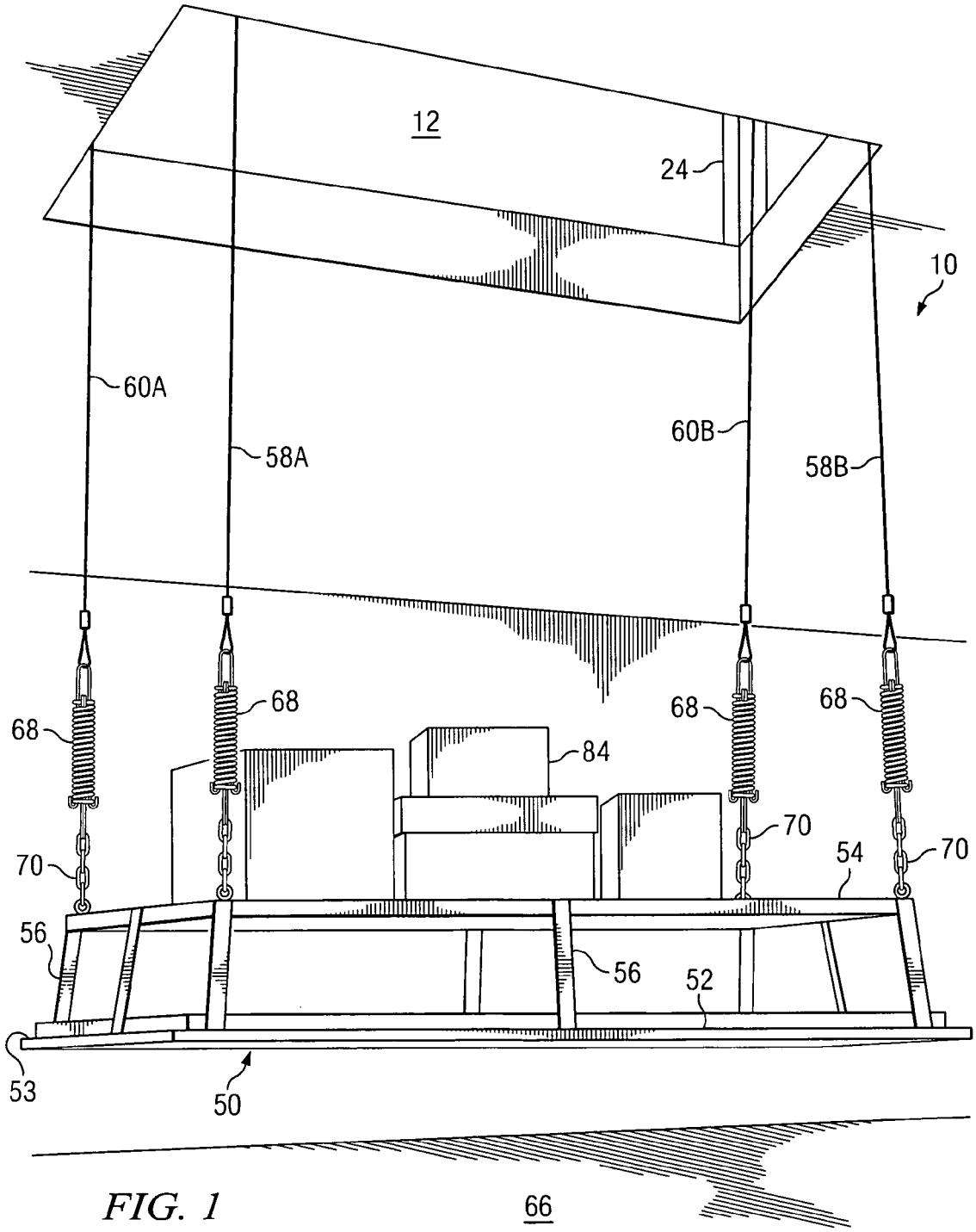
FIG. 1 is a perspective view of a lift platform of a lift system shown in a partially lowered position.

Referring to FIG. 1, a lift system 10 for raising or lowering items or articles from one level to another within a building is shown. The building may be a dwelling or other structure that may have one or more levels. In particular, the lift system 10 may be used with the attic of a building for lifting items to or from the attic to a lower level. The lift system 10 may be provided with an existing attic and used with an existing opening in the ceiling or the like for accessing the attic or a separate opening may be provided in the ceiling to accommodate the lift system 10. Additionally, the lift system 10 may incorporated into an upper level or attic during the construction of the building.

As may be shown and described herein, the lift system 10 may be used with an attic having an opening 12 that is formed in the attic floor and ceiling of the underlying level. It will be understood by those skilled in the art, however, that the lift system may have application to other areas, as well, were it may be desired to move items from one level to another within a building. Openings 12 for accessing attics may commonly be found within hallways and garage areas of homes or buildings that are generally provided with an open space underneath, with no surrounding structure.

The openings 12 may be rectangular in shape. Other shapes for the opening 12 may be used as well. Although the dimensions may vary, such attic openings may range in dimension from about 2 to 4 feet in width to about 2 to 6 feet in length. Smaller openings (egs. 2'×2'or 3'×4') may be used in confined spaces, such as in hallways and the like. Larger openings (eg. 4'×6') may be used in more open areas, such as garages and the like.

Figure 2:
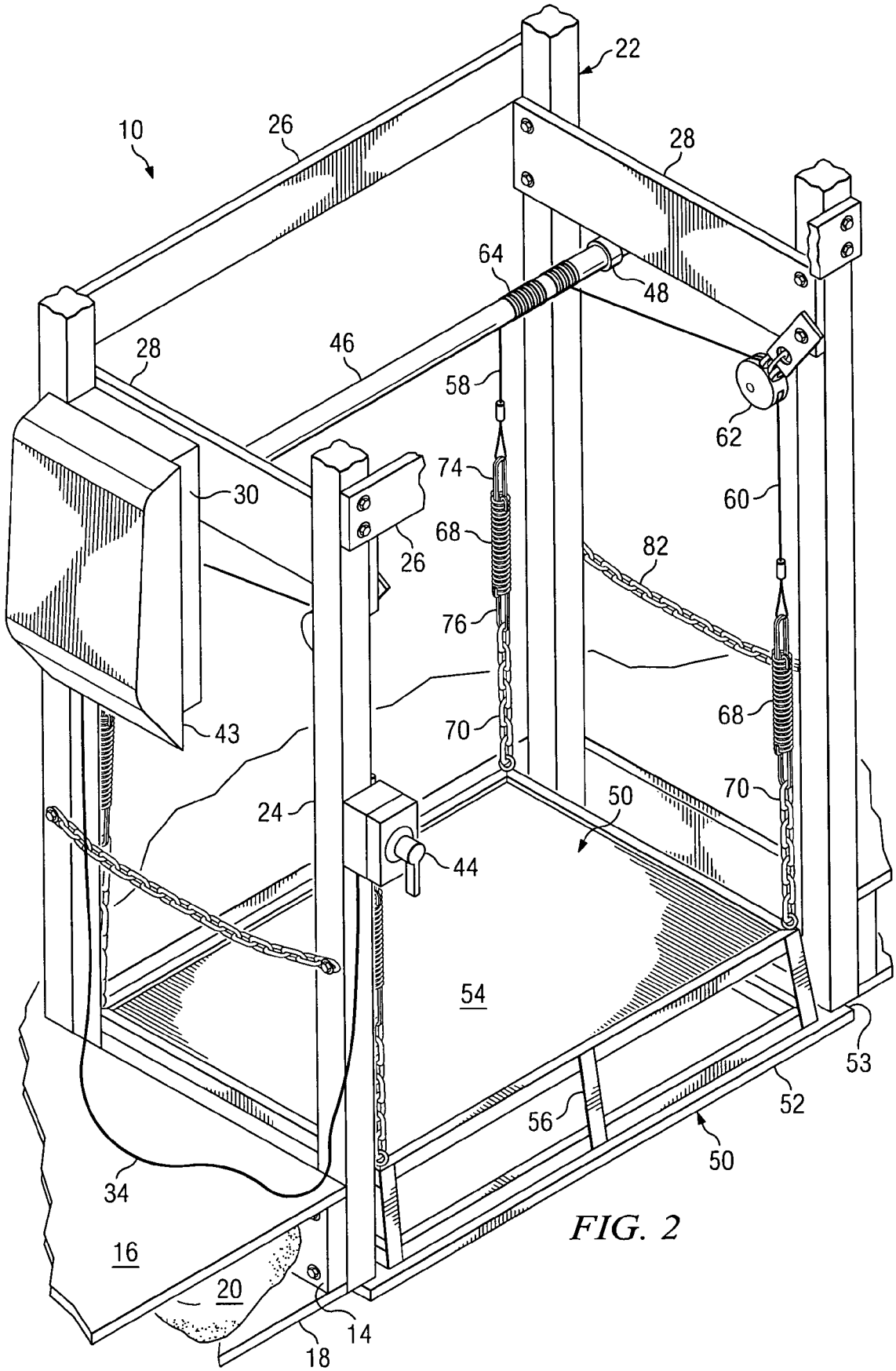
FIG. 2 is a left side perspective view of an upper level support and frame of the lift system.

Referring to FIG. 2, the lift system 10 incorporates a support structure formed from the attic flooring structure. Such structure may include structural components 14, such as joists or beams, which surround the opening 12 and provide structural support for the attic floor. These are typically formed from wood or materials commonly used in the construction of such structures. The joists or beams 14 may support a layer of layers of flooring material 16 of the attic. Additionally, ceiling material 18, such as sheetrock, of the lower level may be secured to the structural components 14. Insulation 20 may be provided in the areas between the joists or beams 14 and the flooring materials 16 and ceiling 18.

If there is no preexisting opening 12, the opening 12 may be formed in the attic floor. Additionally, if the lift system 10 is incorporated into a preexisting building, the support structure around the opening 12 may require reinforcement. This may include adding structural elements about the opening 12, such as additional beams or joists that may be coupled to those already in place. A sufficient thickness in material may be provided by the addition of such elements to facilitate supporting a lift system framework 22 as described herein.

The framework 22 may be formed by providing generally upright posts 24 that are coupled to the support structure 14. The posts 24 may rest on top and be secured to the underlying support structure 14 or they may extend laterally and be secured adjacent to the support structure, as is shown in FIG. 2. A fastening plate (not show) may be used secured to the structure 14 by screws, bolts or other fasteners to facilitate securing of the lower end of the posts 24 to the structure 14. The posts 24 may be provided generally at each corner of the rectangular opening 12. The upper ends of the posts 24 may be secured to existing framing of the roof or other building structure. If necessary, blocking material (not shown) may be used where the posts 24 do not exactly align with joists, beams or the like of the roof framing. Optionally, transverse cross members 26, 28 that are coupled to and extend between adjacent upright posts 24 may be provided.

Figure 3:
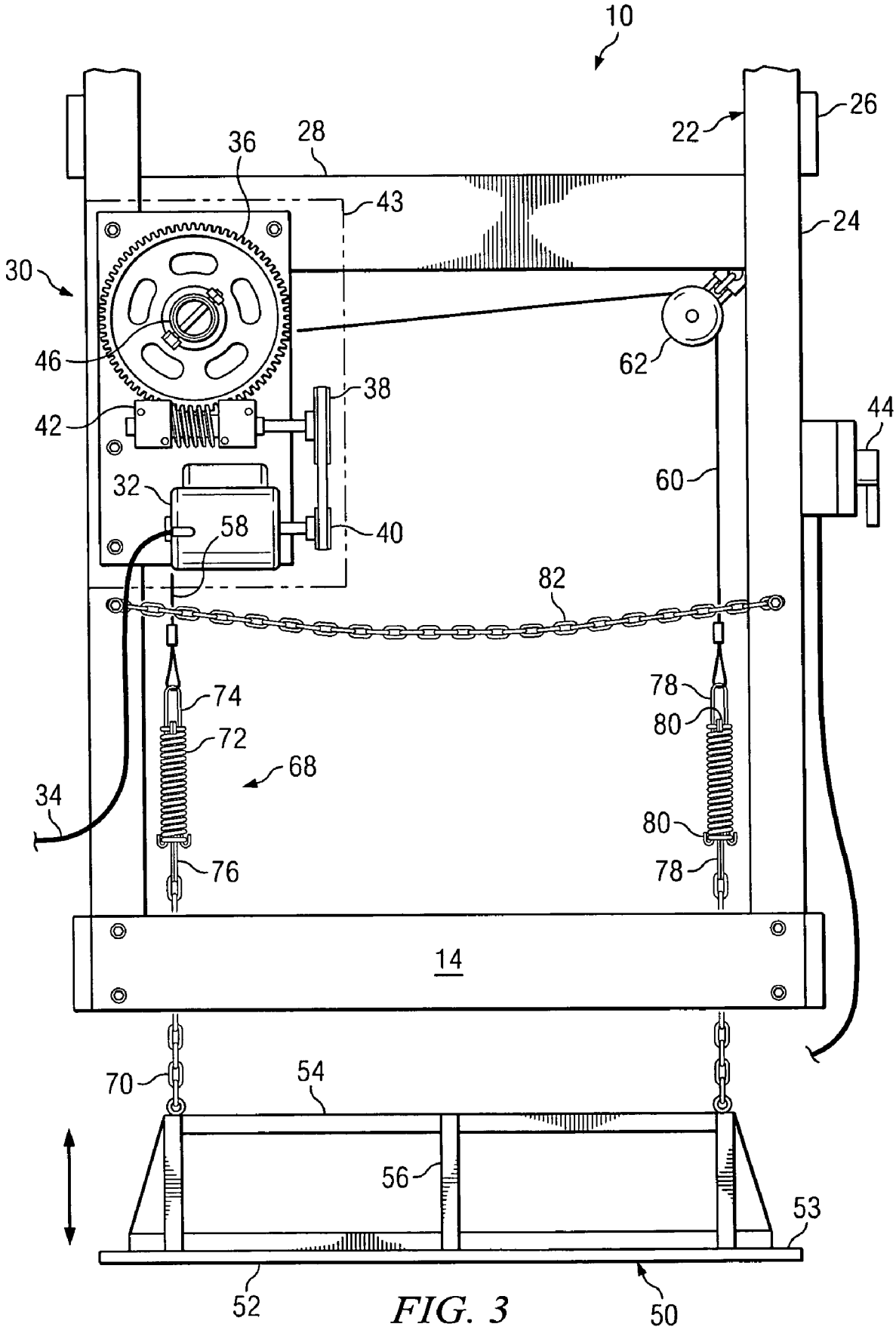
FIG. 3 is a left side elevational view of the lift system.

Referring to FIG. 3, a winch system 30 that is coupled to the framework 22, such as by lag bolts or other fasteners, is shown. The winch system 30 includes a motor 32, which may be an electric-powered motor, that is coupled to a power source, such as the electrical cable 34. In the embodiment shown, the motor 32 may be a reversible motor that is coupled to a main drive gear 36 through pulleys 38, 40 and worm gear 42. This allows the winch system 30 to be reversible so that not only is the winch system 30 capable of lifting loads but it is capable of lowering them, as well. Other motorized drive systems may be used as well. A cover or housing 43 may protect the components of the motor and gear system.

A switch or controller 44 is electrically coupled to the motor 32. In the embodiment shown, the switch 44 is a spring-type switch that must be maintained or held in position by the user during operation of the lift system. When the switch 44 is released by the user, the switch 44 returns to a neutral position to deactivate the motor 32. In an alternate embodiment, a limit switch may be used to deactivate the motor.

The main drive gear 36 is coupled to one end and rotatably drives a horizontally oriented elongate drum 46 (FIG. 4) that is rotatably coupled to the framework 22. The drum 46 may be cylindrical in shape. In the embodiment shown, the drum 46 extends between adjacent posts 24, with one end being coupled to the drive gear 36 of the winch 30 and the other to a bushing or bearing assembly 48 that is coupled to the post 24. In the embodiment show, the assembly 48 is in the form of pipe bushing that rotatably supports the drum 46. As is shown, the drum 46 is located at position well above the opening 12 to facilitate raising or lower of a lift platform 50 (FIG. 1).

It should be noted that the lift platform 50 may have a variety of configurations. Such configurations or designs may vary and depend upon the types of items or articles that may commonly be raised or lowered by the lift system. In the embodiment shown, the lift platform 50 is configured for general purposes and may have a perimeter that is generally rectangular in shape. The platform 50 may include a base 52, which may be configured for resting on the floor or support surface of the lower level when the lift platform is moved to a fully lowered position. In the embodiment shown, the base 52 includes a generally flat panel that serves to close off the opening 12. The outer perimeter of the panel may form a lip 53 that may be configured to abut against the ceiling area surrounding the opening 12, to thus seal the opening 12 when the platform 50 is lifted to a fully raised position. The lower surface of the base 52 may project slightly below the ceiling but may otherwise be or provide a generally flush appearance with the ceiling of the lower level.

The platform 50 may further include a raised deck 54, which is shown supported by the base by means of support members or legs 56, which may be located proximate to the outer edges of the base 52 and deck 54. The deck 54 may be in the form of a panel having a generally flat upper surface. The deck 54 may have an outer perimeter that is generally rectangular in shape and that may be generally concentric with the base 52. The outer perimeter of the deck 54 may be spaced radially inward from the outer perimeter of the base 52. The deck 54 and base 52 may be vertically spaced apart a distance to accommodate the difference in height between the ceiling area 18 of the lower level and the floor 16 of the attic or upper level. When the platform 50 is in the fully raised position, the upper surface of the deck 54 may be generally flush with the floor 16 of the upper level.

It should be noted that the areas of the opening 12 at floor 16 and ceiling 18 may be the same or different, with the open area at the ceiling 18 being slightly larger than the opening area at the floor 16 to accommodate the differences in the outer perimeters of the base 52 and deck 54. This may also facilitate centering of the platform 50 within the opening 12. Additionally, the outer edges of the support members 56 along the outer periphery may be angled inward from the base 52 and serve as guides to center the platform 50 within the opening 12 as the platform 50 is being raised.

The platform 50 is coupled to the winch 30 through four cables 58, 60, which are each coupled at one end to the drum 46. The cables 58, 60 may be formed from steel or other suitable material capable of supporting those loads for which the lift system is to be used. As an example, a suitable cable for certain applications is a 3/16 inch steel aircraft cable. Less than four cables may also be used. For example, a split cable system wherein a single main cable or two main cables attach to the drum 46 and that are split at the opposite ends or couple to other cables to the corners of the platform 50 may also be used. As used herein, the expression "cables" may also encompass other devices, such as chains, ropes, etc., that would also be capable of performing in a similar manner.

Figure 4:
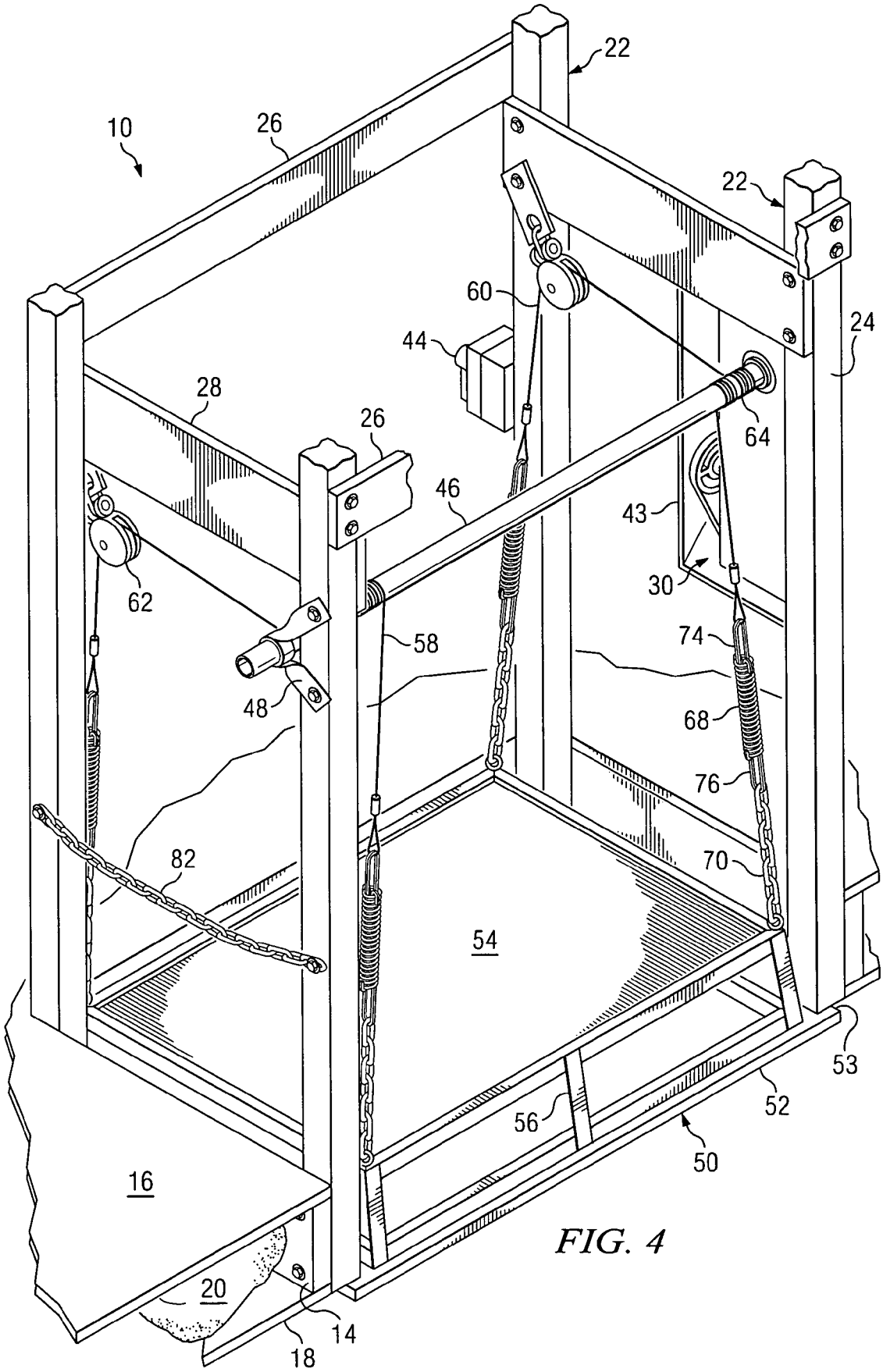
FIG. 4 is a right side perspective view of the upper level support and frame of the lift system.

The following description applies to a winch system utilizing four separate cables. As shown in FIGS. 2 and 4, the drum 46 may be mounted to the frame 22 at a position adjacent to one side of the opening 12. The cables 58A and 58B are each coupled directly to the drum 46 at opposite longitudinal ends of the drum 46. The cable 60A is coupled to the drum 46 adjacent to cable 58A and cable 60B is coupled adjacent to cable 58B. The cables 60A, 60B are passed from the drum 46 and over pulleys or wheels 62, which are mounted to the frame 22 above the opposite side of the opening 12. Each of the cable pairs 58A, 60A and 58B, 60B may be wound about the drum 24 so that the cable pairs 58, 60 wind in close, non-overlapping coils 64, with the coil length for adjacent cables 58 and 60 extending in opposite longitudinal directions along the drum 46 as the cable is wound thereon.

The cables 58, 60 are of sufficient length to allow the lift platform 50 to extend to the lower level for which the system 10 is being used. This may include the lift platform 50 being lowered and rested on a lower level floor 66 (FIG. 1) or other support surface.

When the cables 58, 60 are extended to lower the platform 50 to the lower level so the platform 50 rests on the support surface 66, the cables 58, 60 may be weighted so that they remain taut even when the cables 58, 60 are lowered further. This facilitates keeping the coils 64 closely wrapped about the drum 46 to ensure that the lowering and raising operations of the platform remains smooth and uniform. As an example, for 3/16 inch steel aircraft cables, a weight at the end of each cable 58, 60 of from about 4 to 5 lbs may be sufficient for this purpose. A cable guide system or other methods may be employed to keep the cables 58, 60 winding in close, non-overlapping coils about the drum 46. Other systems that may require less uniform raising and lowering operations may employ less precise winch systems wherein overlapping of the cables is acceptable.

In the embodiment shown, the weight for the cables 58, 60 is provided from springs 68 and chains 70, which are used to couple the cables 58, 60 to the platform 50. The springs 68 may be double acting extension coil springs provided by a spring coil 72 coupled to opposing loop elements 74, 76 for securing to the spring 68 to the cables 58, 60 and chains 70. The opposing loop elements 74, 76 each have an elongate looped portion that passes through the center of the coil 72 and terminates in a looped end 78. The legs of the looped portion terminate in outwardly projecting hooks 80 for engaging the ends of the coil 72. One or more loop elements 74, 76 may be used for each spring coil 72. Other spring configurations may be used for the spring 68, as well. For the particular springs 68 shown, which may be employed in a home attic, the spring coils 72 may each have a length of about 10 to 16 inches.

The set of springs 68 may be selected to provide a desired load handling capability. An example of a suitable load rating for many lift system applications is from about 1000 lbs to about 5000 lbs, more typically from 2000 to 3000 lbs for home attic applications. In such systems employing a set of four springs, each spring may therefore have a load rating of 250 to 1250 lbs/spring. Further, the springs may have a spring constant rating of from 50 to 500 lbs/inch, more typically from 100 to 250 lbs/inch for home attic applications.

As shown in FIGS. 2 and 4, the lip 53 of the platform 50 may engage the edges of the ceiling 18 or structure immediately surrounding the opening 12 to prevent further upward movement of the platform 50 and to seal the opening 12. Other engagement means may be provided to prevent further upward movement of the platform 50 through the opening 12. The springs 68 provide a certain amount of play and tension when raising the lift system platform 50 to provide proper seating of the lift platform 50 within the opening 12. The springs 68 may expand linearly from greater than 0 inches to 5 inches or more to provide this play and to provide tension on the lift platform 50 when seated within the opening 18.

Chains, guards or other barrier devices 82, which may be removable or releasable, may be provided that extend around and be coupled to the frame 22 to prevent access to the opening 12 when the platform 50 is lowered.

In operating the lift system 10, the lift platform 50 may initially be in the fully raised position, as is shown in FIGS. 2 and 4. In the fully raised position, the peripheral lip 53 of the base 52 may engage the ceiling 18 of the lower level immediately surrounding the opening 12 to prevent further upward movement of the platform 50. The wench system 30 is initially deactivated so that the lift platform is maintained in place in the fully raised position. If desired, additional releasable locking devices (not shown) may be provided that engage the platform or winch system when in the fully raised position to further facilitate maintenance of the platform in this position.

When in the fully raised position, the deck 54 of the platform 50 may be generally flush with the surrounding floor area of the uppermost level for which the lift system is being used. It may also be recessed or raised, if desired. Items may be removed or be placed on the platform for lowering when in the fully raised position at the upper level.

To lower the platform 50, a user operates the switch 44. As discussed earlier, the switch 44 may be a spring switch so that the user must maintain the switch in the lowering mode position during the lowering operation. Providing the switch 44 in an area immediately adjacent to the opening 12 may ensure that the operator is in visual proximity to the platform 50 as it is being lowered so that the user can determine when the platform is fully lowered or raised. Alternatively, a limit switch may be used to deactivate the motor 32 when the platform 50 reaches the fully lowered or raised positions. Such limit switches may include mechanical activated switches, infrared activated switches, etc. The limit switches may be activated upon a certain length of time or number of rotations of the drum 46 or motor 32. Other limiting methods that are known to those skilled in the art may also be used.

The winch system 30 may raise and lower the platform 50 at a rate of from about 0.05 ft/sec to about 0.15 ft/sec. This ensures that the cables 58, 60 unwind smoothly and facilitates prevention of uncontrolled swinging or side to side movement of the platform 50 as it is being lowered.

When the platform 50 is fully lowered, the base 52 may rest on the floor of the lower level floor or support surface 66. The user may release the spring switch 44 to deactivate the motor 32 to prevent further unwinding of the cables 58, 60 from the drum 46. Alternatively, a limit switch may deactivate the motor 32 to prevent further unwinding of the cables 58. The springs 68 and chains 70 may provide sufficient weight to keep the cables 58, 60 taut even when some length of the cables 58, 60 continues to unwind. This allows some tolerance if the user does not immediately switch off the motor 32 when the platform 50 is fully lowered.

The items such as the items 84 (FIG. 1) may then be removed from the deck 54 or platform. Ramps (not shown) may be provided with the platform 50 to facilitate unloading or loading of items or articles from or onto the raised deck 54.

After items are removed or placed on the platform 50 at the lower level, the platform 50 may then be raised. The user operates the switch 44 by holding the switch 44 in a raised mode position. This activates the motor 32 to reverse rotation of the drum 46 so that the cables 58, 60 are wound about the drum 46. As discussed earlier, the cables 58, 60 may wind about the drum 46 in close, non-overlapping coils. The adjacent coil of each cable length may act as a guide as the length of cable is wound about the drum 46 so that the coil length grows linearly along the length of the drum 46. To achieve this, one coil may be provided on the drum 46 even when the platform 50 is lowered to a fully lowered position. Optionally, cable grooves may be formed in the drum 46 or other devices may be used to facilitate uniform winding.

As the platform 50 is raised to the fully raised position, the lip 53 of the base 52 engages the area of ceiling 18 immediately surrounding the opening 12. This prevents further raising of the platform 50 and seals the opening 12. The springs 68 provide an amount of play or tolerance if the user does not immediately switch off the motor 32 when the platform 50 is fully raised. The springs 68 may also provide tension to maintain proper seating of the lift platform 50 within the opening 12.

When in the fully raised position, items may be removed from or placed on the platform 50 at the upper level.

The operations previously described may be repeated if necessary.

The lift system may be provided in an existing home or building and may utilize the existing opening to an attic. The lift system may also be installed during the initial construction of such structures. The lift system provides a means to raise and lift heavy articles or items to an attic or other upper level to or from an open area of a lower level that typically could not be carried up stairs typically used for accessing such areas. The lift system utilizes a free-swinging support or platform that eliminates the need for a designated elevator shaft or a laterally adjacent support or guidance system that would otherwise clutter or take up space within such open areas, such as hallways, garages and the like.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim:

1. A lift system for lifting or lowering items from one level to another within a building, the system comprising:

a lift platform;

an upper level support structure having an opening configured to allow passage of the platform through the opening, the opening being suspended above a generally open area of a lower level;

an upper level frame coupled to the upper level support structure;

a winch having a motor that rotates a single drum supported by the upper level frame at a position spaced a substantial distance above the opening;

four biasing members, each biasing member having having a length of about 10 to 16 inches and a spring constant of from 50 to 500 lbs/inch and that expands linearly 5 inches or more to provide an amount of play and tension on the lift platform when the lift platform is seated within the opening;

four lengths of cable, each length of cable secured at one end to the winch and at an other end to separate areas of the platform through one of the biasing members; and wherein operation of the winch rotates the drum to wind or unwind the cable lengths to raise or lower the platform through the open area of the lower level without any laterally adjacent support or guidance structure within the open area.

2. The lift system of claim 1, wherein:

the biasing member has a spring constant of from about 100 to 250 lbs/inch.

3. The lift system of claim 1, wherein:

the lift platform has a base and a deck vertically spaced above the base, the lift platform being configured to allow passage of the deck of the platform through the opening, the deck having an outer perimeter that is spaced inwardly from the outer perimeter of the base, and wherein the lift platform has angled guides along the outer periphery that extend from the base to the deck to facilitate centering of the lift platform within the opening as the lift platform is raised.

4. The lift system of claim 1, wherein:

the cable is weighted with the biasing member so that the cable remains taut after the platform is lowered and resting on a support of the lower level.

5. The lift system of claim 1, wherein:

the lift platform is provided with an outward projecting rim that engages edges of the upper level support structure surrounding the opening when the lift platform is in a fully raised position.

6. The lift system of claim 1, wherein:

the length of cable is coupled to the drum so that the cable is wound about the drum in close, non-overlapping coils wound longitudinally along the length of the drum.

7. The lift system of claim 1, wherein:

the opening is located in the ceiling of a hallway or garage.

8. A method of lifting or lower an object to or from an attic of a building to a generally open area of a lower level that has no laterally adjacent support or guidance structure, the method comprising:

providing a lift platform and an upper level support structure having an opening configured to allow passage of the platform therethrough, the opening being suspended above the open area of the lower level, the lift platform having a base and a deck vertically spaced above the base, the lift platform being configured to allow passage of the deck of the platform through the opening, the deck having an outer perimeter that is spaced inwardly from the outer perimeter of the base, and wherein the lift platform has angled guides along the outer periphery that extend from the base to the deck to facilitate centering of the lift platform within the opening as the lift platform is raised;

providing an upper level frame coupled to the upper level support structure and a winch having a motor that rotates a single drum supported by the upper level frame at a position spaced a substantial distance above the opening;

providing four lengths of cable, each length of cable secured at one end to the winch and at an other end to separate areas of the platform through a biasing member having a length of about 10 to 16 inches and having a spring constant of from 50 to 500 lbs/inch and that expands linearly five inches or more to provide an amount of play and tension on the lift platform when the lift platform is seated within the opening;

positioning an object to be raised or lowered upon the platform; and operating the winch to rotate the drum to wind or unwind the lengths of cable to raise or lower the platform through the open area of the lower level, the lengths of cable being wound about the drum in close, non-overlapping coils wound longitudinally along the length of the drum.

9. The method of claim 8, wherein:

the platform is raised or lowered at a rate of from about 0.05 to about 0.15 ft/sec.

10. The method of claim 8, wherein:

the lift platform provides a closure for the opening when in a fully raised position.

11. The method of claim 8, wherein:

the biasing member has a spring constant of from about 100 to 250 lbs/inch.

12. The method of claim 8, wherein:

the upper level support includes the floor of an attic.

13. The method of claim 8, wherein:

the lift platform is provided with an outward projecting rim that engages edges of the upper level support structure surrounding the opening when the lift platform is in a fully raised position.

14. The method of claim 8, wherein:

the lift platform has a generally rectangular configuration, and wherein the lengths of cable are each secured to a corner of the lift platform.

15. The method of claim 8, wherein:

the opening is located in the ceiling of a hallway or garage.

16. A self-centering lift system for lifting or lowering items from one level to another within a building, the system comprising:

an upper level support structure having an opening, the opening being suspended above a generally open area of a lower level;

a lift platform having a base and a deck vertically spaced above the base, the lift platform being configured to allow passage of the deck of the platform through the opening, the deck having an outer perimeter that is spaced inwardly from the outer perimeter of the base, and wherein the lift platform has angled guides along the outer periphery that extend from the base to the deck to facilitate centering of the lift platform within the opening as the lift platform is raised, the lift platform also being provided with an outward projecting rim that engages edges of the upper level support structure surrounding the opening when the lift platform is in a fully raised position;

an upper level frame coupled to the upper level support structure;

a winch having a motor that rotates a drum supported by the upper level frame;

four lengths of cable that are each secured to separate areas of the lift platform through biasing members, the four lengths of cable each being secured at opposite ends to the drum of the winch; and wherein operation of the winch rotates the drum to wind or unwind the cables in close, non-overlapping coils wound longitudinally along the length of the drum to raise or lower the platform through the open area of the lower level without any laterally adjacent support or guidance structure within the open area, and wherein the biasing members expand linearly to provide tension on the lift platform when the lift platform is seated within the opening; and wherein the cables are weighted so that the cables remain taut after the platform is lowered and resting on a support of the lower level; and wherein the biasing members are coiled springs having a length of from about 10 to 16 inches and are capable of expanding linearly by 5 inches or more to provide an amount of play and tension on the lift platform when the lift platform is seated within the opening.

17. The lift system of claim 16, wherein:

the cables are weighted by the weight of the biasing members.

18. The lift system of claim 16, wherein:

the biasing member has a spring constant of from about 100 to 250 lbs/inch.

19. The lift system of claim 16, wherein:

the platform is raised or lowered at a rate of from about 0.05 to about 0.15 ft/sec.

20. The lift system of claim 16, wherein:

the opening is located in the ceiling of a hallway or garage.

* * * * *